US007106261B2

(12) United States Patent
Nagel et al.

(10) Patent No.: US 7,106,261 B2
(45) Date of Patent: Sep. 12, 2006

(54) SYSTEM FOR REMOTELY CONTROLLING AN ELECTRICAL SWITCHING DEVICE

(75) Inventors: Paul E. Nagel, Sandy, UT (US); James K. Russell, Sandy, UT (US); Roger T. Johnsen, Salt Lake City, UT (US); Paul B. Vincent, Centerville, UT (US)

(73) Assignee: Control4 Corporation, Draper, UT (US)

( * ) Notice: Subject to any disclaimer, the term of this patent is extended or adjusted under 35 U.S.C. 154(b) by 65 days.

(21) Appl. No.: 11/066,845

(22) Filed: Feb. 25, 2005

(65) Prior Publication Data

US 2005/0184915 A1 Aug. 25, 2005

Related U.S. Application Data

(60) Provisional application No. 60/547,494, filed on Feb. 25, 2004.

(51) Int. Cl.
*H01Q 1/24* (2006.01)

(52) U.S. Cl. ..... 343/702; 315/149

(58) Field of Classification Search ..... 343/702, 343/700 MS, 745, 746, 767, 770; 315/149, 315/158, 312, 292, 294; 200/344; 455/90
See application file for complete search history.

(56) References Cited

U.S. PATENT DOCUMENTS 5,561,437 A * 10/1996 Phillips et al. ..... 343/702
5,736,965 A 4/1998 Mosebrook et al.
5,982,103 A 11/1999 Mosebrook et al.
6,002,092 A * 12/1999 Pan ..... 200/344
6,107,584 A * 8/2000 Yoneyama ..... 200/344
6,111,207 A * 8/2000 Arterberry et al. ..... 200/5 R
6,396,458 B1 * 5/2002 Cockson et al. ..... 343/860
6,600,450 B1 * 7/2003 Efanov et al. ..... 343/726
6,687,487 B1 2/2004 Mosebrook et al.
6,803,728 B1 * 10/2004 Balasubramaniam et al. .... 315/149
2005/0184677 A1 * 8/2005 Johnsen et al. ..... 315/194

* cited by examiner

*Primary Examiner*—Trinh Dinh
*Assistant Examiner*—Huedung X. Cao
(74) *Attorney, Agent, or Firm*—Thorpe North & Western LLP

(57) ABSTRACT

A system for remotely controlling an electrical switching device is disclosed. The system includes a mounting fixture configured to be mounted in a wall. An electrical switching device is supported by the mounting fixture. The system also includes a cover configured to cover at least a portion of the mounting fixture. The system further includes a shielding plate configured to have a high electrical conductivity. The shielding plate is mounted proximate to the mounting fixture between the cover and the electrical switching device. The system also includes a directional, non-isotropic radio frequency (RF) antenna sized to fit within the cover and configured to transmit RF frequency signals. The RF antenna is located between the shielding plate and the cover at a predetermined distance from the shielding plate. The predetermined distance is selected to increase the capability of the RF antenna to send and receive the RF signals.

23 Claims, 4 Drawing Sheets

SYSTEM FOR REMOTELY CONTROLLING AN ELECTRICAL SWITCHING DEVICE

CROSS-REFERENCE TO RELATED APPLICATIONS AND CLAIM OF PRIORITY

This application claims the benefit of U.S. application No. 60/547,494 filed Feb. 25, 2004.

BACKGROUND

People have desired home automation for years. The ability to remotely control electrical fixtures, appliances, and electronics remotely or through a central location has often seemed like it was just a few years away. However, the revolutionary automated home of the future has remained illusive. The few products that have been made available are often so expensive that they are typically used only by the wealthy and in prototype homes of the future. Many automation products also lack the necessary functionality to enable a truly automated home.

Even a decade ago, creating an automated home usually meant that the necessary wiring and infrastructure had to be installed during a home or building's construction. The wiring alone could cost tens of thousands of dollars. The field of home automation has been incongruent, with differing products unable to affectively communicate. These incompatibilities have further limited the potential of creating interconnected, remotely controlled homes and buildings.

In the last several years a wireless infrastructure has been developed. Computers having wireless connections are now ubiquitous. Homes and buildings no longer need to have expensive networking cables installed to enable computers to communicate over the Internet. Standards such as IEEE 802.11b have been set which allow the computers to communicate with the Internet and with each other.

However, the wireless infrastructure developed for computers has drawbacks for home automation. The transmitters and receivers are expensive and have a limited range. Homes and buildings can have dead spots where signals have too little power to be received. Wireless devices connected using the 802.11b standard typically can only communicate with a central hub. They usually cannot intercommunicate.

Embedding a radio frequency (RF) or wireless device such as an 802.11b transceiver into typical residential or commercial structures, such as a wall switch junction box, has a number of technical challenges. Installation practices and materials vary widely. One of the worst environments is a metal junction box which is used in older homes and some new construction of residential and commercial buildings.

SUMMARY

Figure 1:
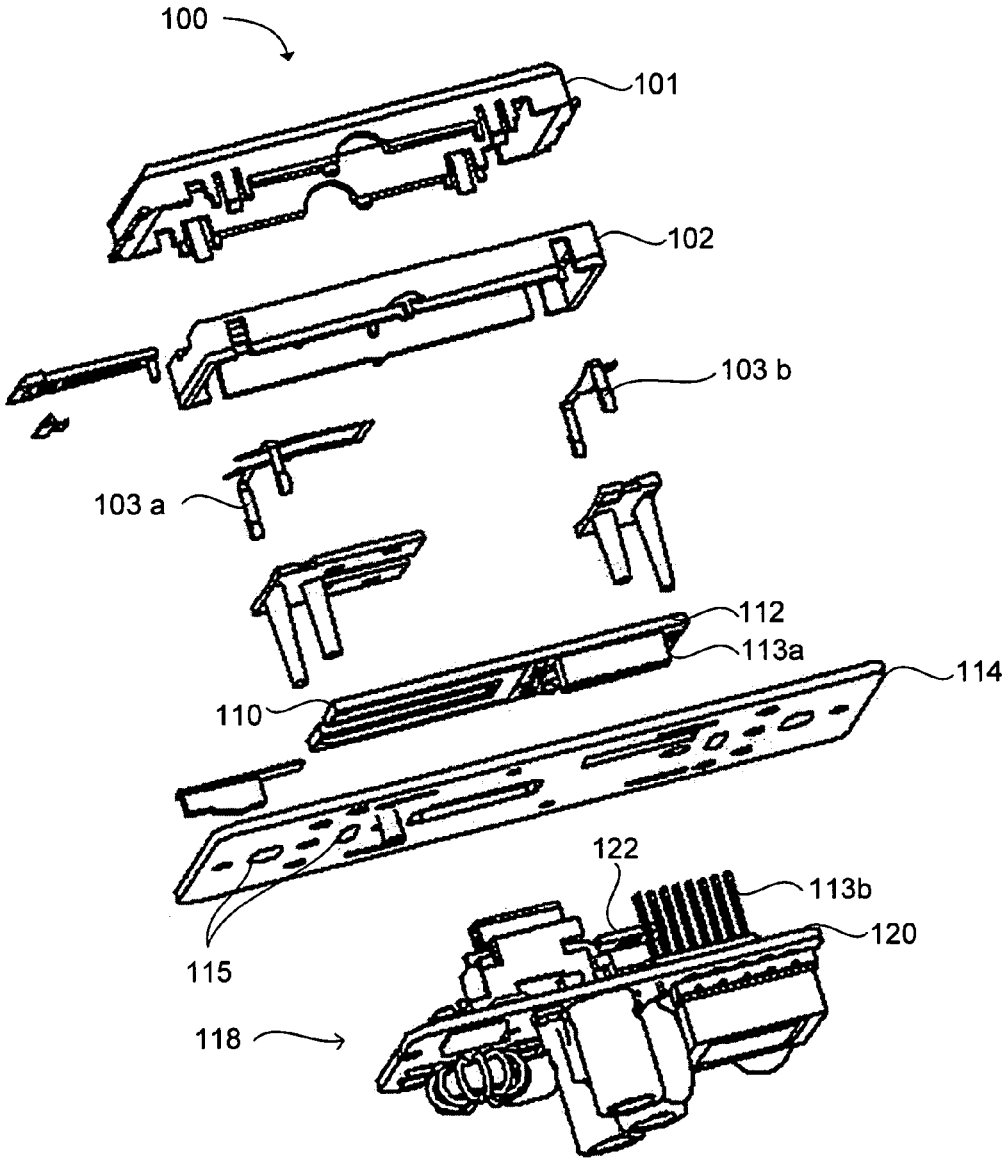
FIG. 1 is a perspective view of a system for remotely controlling an electrical switching device in accordance with an embodiment of the present invention.

A system for remotely controlling an electrical switching device is disclosed. The system includes a mounting fixture configured to be mounted in a wall. An electrical switching device is supported by the mounting fixture. The system also includes a cover configured to cover at least a portion of the mounting fixture. The system further includes a shielding plate configured to have a high electrical conductivity. The shielding plate is mounted proximate to the mounting fixture between the cover and the electrical switching device. The system also includes a directional, non-isotropic radio frequency (RF) antenna sized to fit within the cover and configured to transmit RF frequency signals. The RF antenna is located between the shielding plate and the cover at a predetermined distance from the shielding plate. The predetermined distance is selected to increase the capability of the RF antenna to send and receive the RF signals.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

An embodiment of the present invention showing a system 100 for remotely controlling an electrical switching device is illustrated in FIG. 1. The system can include a radio frequency (RF) antenna 110 coupled to an electrical control or electrical switching device 118 (hereinafter "switching device"). The switching device can be used for switching an electrical load such as an incandescent light, fluorescent light, electrical plug, appliance, electronic device, television, garage door opener, or any other electrical load.

The radio frequency antenna can be used to communicate with a remote device such as a remote control or a separate switching device. For example, a remote control can be used to control the lighting within a house, room, or building. The remote control can communicate with the switching device via the RF antenna. The remote control can be used to transmit a signal to the RF antenna and to enable a user to remotely turn the lights on and off. Alternatively, the control may be used to modify the level of the lighting when the switching device is a dimmer. Information can be transmitted by the RF antenna to the remote control in order to enable the user to know the status of the switching device. For example, the switch may transmit information regarding whether the power is on or off or the level at which the lights are set.

The remote control may be a handheld device similar to a remote control typically used to control televisions. Alternatively, the remote control could be a more complex control having a viewing screen, such as an LCD screen which can be used to control a variety of devices. The LCD screen may be a touch screen. The remote control may also be a computer used to control a plurality of remote controlled devices.

The RF antenna and associated circuitry can be configured to be part of a mesh network. A wireless network based on the IEEE 802.11b standard typically has each node in the network communicate with a central source, which is typically part of a wired network. In contrast, each mesh network node within the network can communicate with other nodes in the network. In one embodiment, every node can communicate with every other node. In another embodiment, nodes can communicate with other nodes in the wireless network that are within range. This can enable nodes to be placed outside the range of the central source that is attached to a wired network. The nodes can communicate by acting as repeaters and distant nodes can communicate with the central source by transmitting their signals to other nodes, which pass the information on to the central source. Because the nodes do not have to transmit a great distance, the RF antenna and associated circuitry can be made inexpensively.

Each remotely controlled electrical switching device can be part of a mesh network. The mesh network can enable a large number of switching devices to be remotely controlled without requiring each switch to be within range of a controller. Using wireless communications standards for mesh networks, such as the ZigBee® standard, can enable the switching devices to communicate with other electronic devices and to be inexpensively controlled. The low cost, low power wireless networks can help implement an affordable automated home.

The RF antenna 110 can be configured to be coupled to, or applied upon, a first printed circuit board (PCB) referred to as an RF PCB 112. The switching device 118 can be mounted on a second PCB referred to as a switching PCB 120. In one embodiment, the switching device 118 can be used to control an electronic dimmer. A gated electronic switching device called a triac 122 can be used to control voltage going to an electrical load, such as a light bulb. The triac can conduct in either direction. Due to the finite resistance of the conducting path through the triac, significant heat is generated in controlling the dimming of the light bulb.

A plate formed from a material having a high thermal and electrical conductivity, such as aluminum, is typically used to dissipate heat from the triac. The plate is often referred to as a yoke plate 114. The yoke plate 114 can operate as a shielding plate used to provide RF shielding between the RF PCB 112 and the switching PCB 120. Electromagnetic radiation produced by electronics located on the switching PCB can interfere with the operation of the RF antenna 110 mounted on the RF PCB. The yoke plate can be used to substantially reduce the electromagnetic radiation near the RF antenna which is generated by the switching PCB electronics. The RF PCB and the switching PCB can be electrically coupled using a connector system with a pin socket 113*a* and a multi-pin stick header 113*b* on the switching PCB which passes through the yoke plate. The yoke plate can also be used to provide a safety ground to protect users from high voltage (120 V or 230 V) circuits. The RF antenna and electrical components on the RF PCB can be electrically isolated from electrical components on the switching PCB through the use of a 120 V or 230 V universal mains switch mode power supply.

In one embodiment, the RF antenna 110 can be sized such that it can be mounted within a junction box cover, such as a Decora-style sized switch keycap 102. The switch keycap can be surrounded by a switch keycap frame 101. In addition, a user can touch the switch keycap to control the dimming and/or switching functions of a switching device. The antenna can be mounted as far in front of the yoke plate 114 as possible, while still remaining covered by the switch keycap. The antenna may also be mounted to the yoke plate at a predetermined distance from the yoke plate.

Electrostatic discharge contacts 103*a* and 103*b* can be formed from a material having a high electrical conductivity such as copper. The contacts can form an electrically conductive path between a switch cover such as the switch keycap 102 and ground. In one embodiment, the electrostatic discharge contacts can be coupled to the keycap and form a conductive path with the yoke plate 114. The yoke plate, in turn, is connected to ground. The electrostatic discharge contacts can form a path to allow static charges to be directed to ground. This can minimize the risk of a static charge from a user touching the keycap and potentially damaging or resetting the electrical components under the keycap and within the junction box or mounting fixture.

Wall mounted switching devices such as light switches and dimmers are typically placed inside a junction box or mounting fixture. In commercial construction, metal junction boxes are often used. Metal junction boxes, along with the metal yoke plate, can act as a Faraday cage, minimizing the transmission of any radio frequency electromagnetic radiation which occurs inside the box. Placing the antenna as far in front of the yoke plate as possible enables the antenna to be further outside the junction box therefore resulting in a more omni direction (isotropic) radiation pattern may be transmitted by the antenna. In addition, the location of the antenna can reduce attenuation of signals transmitted to the antenna.

Figure 2A:
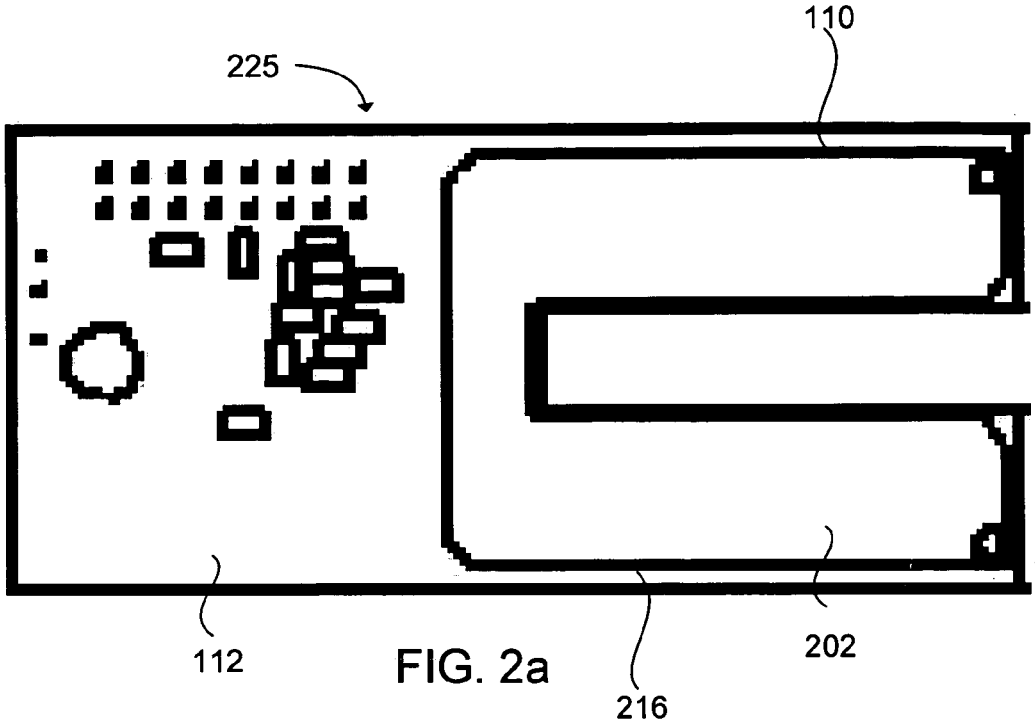
FIG. 2*a* is a front view of an RF printed circuit board having a patch antenna in accordance with an embodiment of the present invention.
Figure 2B:
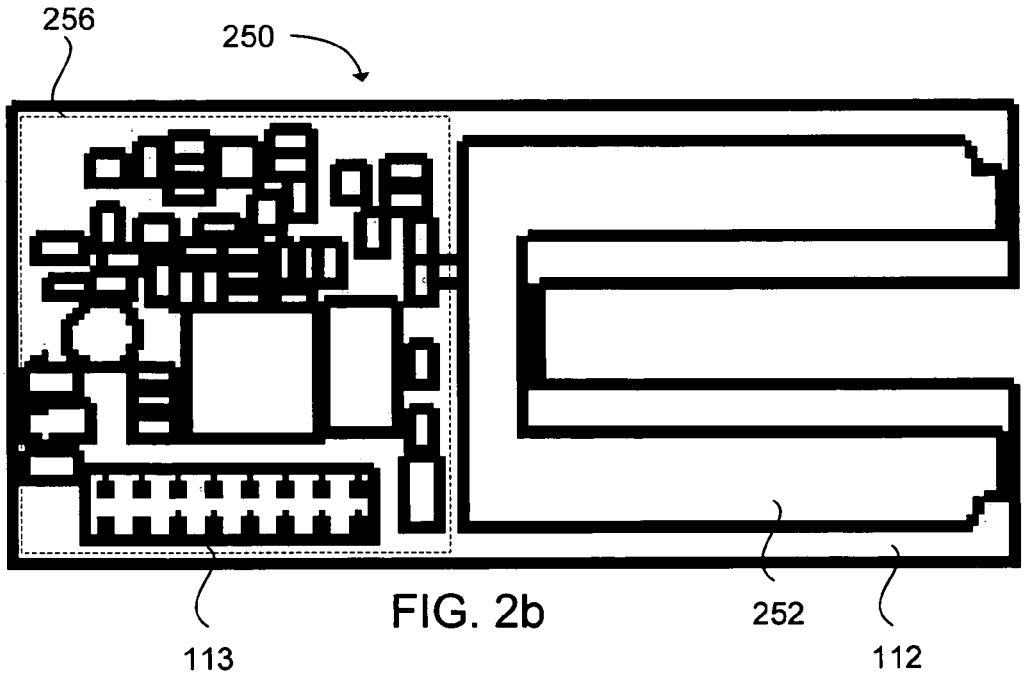
FIG. 2*b* is a back view of the RF printed circuit board of FIG. 2*a*, showing RF transceiver circuitry mounted on the back in accordance with an embodiment of the present invention.

FIGS. 2*a* and 2*b* show a front 225 and back 250 side of the RF PCB 112, respectively. In one embodiment, the RF antenna 110 can be configured as a printed antenna comprising one or more printed conductors on a dielectric substrate. The printed antenna may be a C-shaped, multilayer, microstrip patch antenna comprising a microstrip portion 252 located on the back side of the dielectric substrate and a patch antenna 202 located on the front side of the RF PCB. RF signals can be fed to the microstrip from a power amplifier through an impedance matching circuit and in turn the microstrip can feed a low noise amplifier for receiving RF signals. The power fed into the microstrip portion can be coupled to the patch antenna through the substrate. The dielectric substrate can be used for the RF PCB 112. The patch antenna can be configured to have a size and shape relative to the microstrip such that the antenna will resonate electromagnetic energy at a predetermined frequency.

While the example embodiment shown in FIGS. 2*a* and 2*b* shows a C-shaped, multilayer, microstrip patch antenna, it is also possible to use different types of antennae. The antenna may take any form of microstrip antenna, or any antenna which can fit within the confines of a Decora-sized switch keycap cover and can radiate and receive RF energy at predetermined power requirements. For example, an antenna may be used with the present system that has a 6 dBm signal fed to it and can work in conjunction with RF transceiver circuitry to receive a signal having a power of −80 dBm. In addition, other types of antenna that may be used within a switch keycap can include a dipole antenna, co-axial feed wire antenna, a chip antenna, ceramic chip antennas, and similar antenna structures that can be sized to fit within a switch keycap.

RF transceiver circuitry 256 may be located on the back of the substrate. The RF transceiver circuitry can include the low noise amplifier and power amplifier comprising the analog front end, a radio transceiver, a transceiver clock, power conditioning circuitry, and other circuitry necessary to transmit and receive RF signals through the RF antenna. A connector system 113*a*, 113*b* can be used to connect the digital portion of the RF transceiver circuitry to the switching device 118 (FIG. 1) circuitry located on the switching PCB 120.

Returning to FIG. 2*a*, the patch antenna 202 can be designed to operate at a predetermined frequency. Design parameters can include the width, length, and thickness of the conductor used to form the microstrip portion 252 (FIG. 2*b*) and the patch antenna, the distance between the two conductors, the dielectric properties of the substrate, and the location of the antenna relative to other conductive materials.

In one embodiment, the RF antenna 110 can be designed to operate at a center frequency around 2.45 GHz. A portion of electromagnetic spectrum around 2.45 GHz was left open to the public by the Federal Communications Commission because it is the frequency at which microwave ovens typically operate. Until recently, interference by microwave ovens made this range of spectrum undesirable to design engineers. However, advancements in the field of RF communications have made it possible to use this unlicensed bandwidth.

Figure 3:
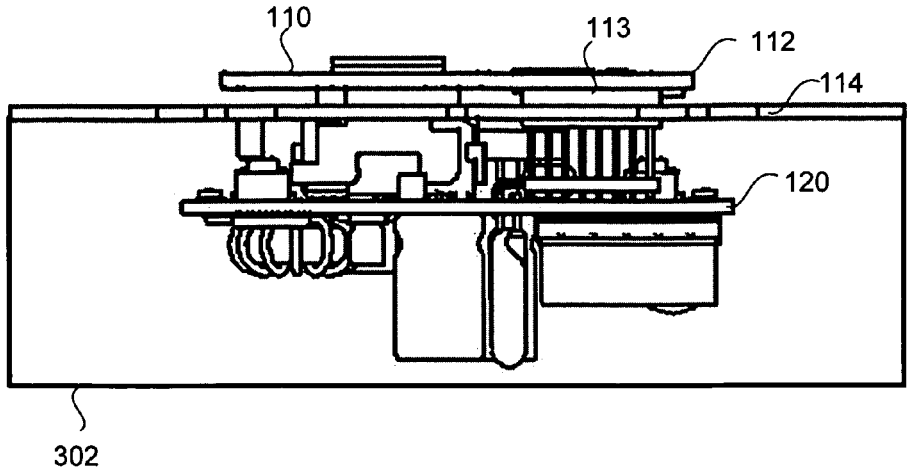
FIG. 3 is a side view of an RF printed circuit board connected to a switching circuit board through a yoke plate in accordance with an embodiment of the present invention.

FIG. 3 shows the RF PCB 112 coupled to the switching PCB 120 using the connector 113 which passes through the yoke plate 114. The RF PCB is positioned a predetermined distance from the yoke plate to enable the RF antenna 110 to operate optimally. The yoke plate is mounted to a junction box 302. The RF PCB is located outside the junction box in front of the yoke plate. Locating the RF transceiver circuitry 256 on the RF PCB 112 (which is placed in front of the yoke plate) can provide an increased amount of electromagnetic isolation between the antenna and RF transceiver circuitry located on the RF PCB and the power and switching circuitry located on the switching PCB. The isolation can minimize interference in the RF transceiver circuitry caused by the switching device circuitry.

Figure 4:
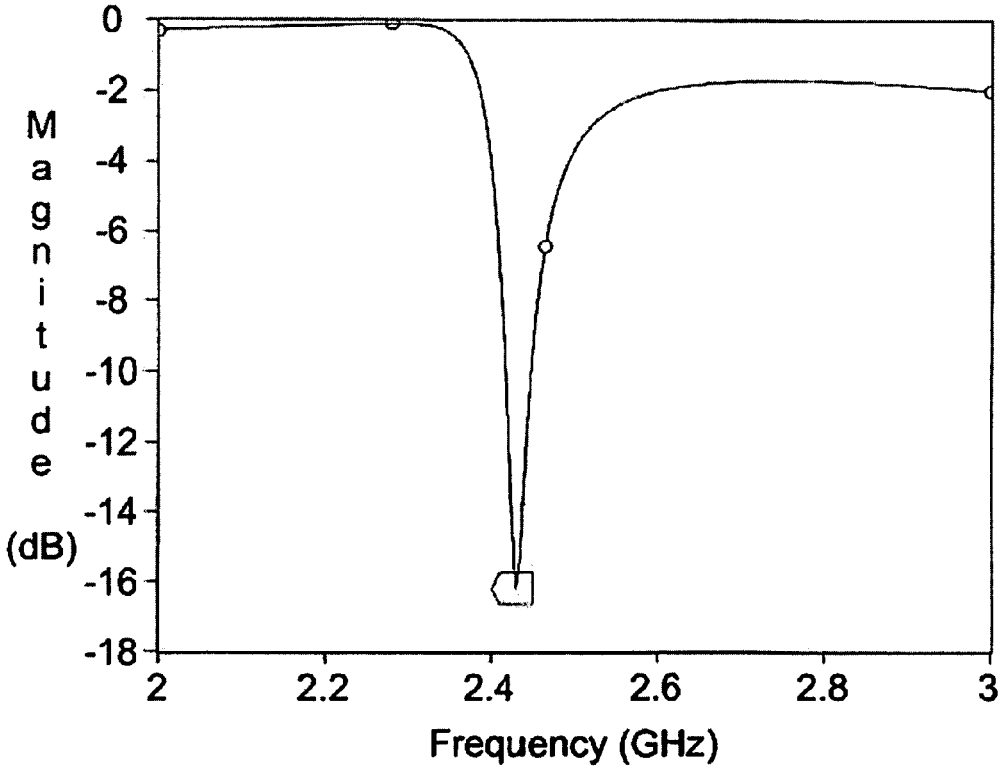
FIG. 4 is a plot of a measurement of return loss, as measured in dB, in an RF antenna relative to frequency.

FIG. 4 shows a plot made of a measurement of the return loss of a patch antenna designed to operate at a center frequency around 2.45 GHz. Return loss can be determined by connecting a network analyzer to an antenna and measuring the amount of reflected power relative to the incident power at a network analyzer port. FIG. 4 shows a return loss measurement of the patch antenna that is greater than −16 dB at a frequency of 2.4 GHz. When operating the antenna at a center frequency around 2.45 GHz, a large return loss can be obtained for one embodiment of the antenna by placing the antenna at a distance of 0.079 inches to 0.085 inches from the yoke plate 114 (FIG. 1), which can be used as a ground plane. At this distance, the coupling effect of the ground plane on the antenna enables the antenna to operate with an increased gain. Of course, other antenna placement distances can also be used to maximize gain.

Figure 5:
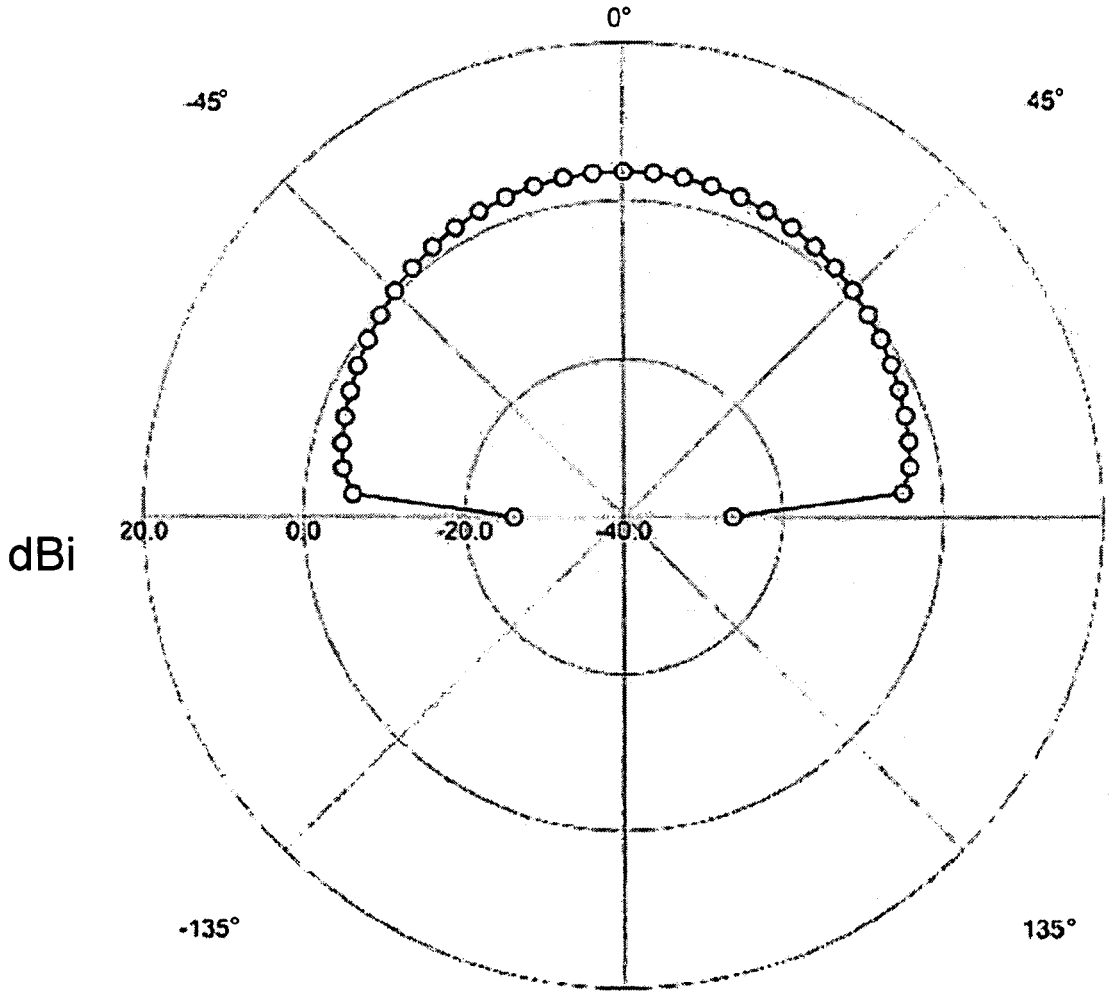
FIG. 5 is a plot of is a far field plot showing antenna gain, measured in dBi, on a 180 degree surface.

FIG. 5 shows a theoretical polar plot of a patch antenna's gain when the patch antenna has a geometry as shown in FIG. 2. The plot shows the antenna's theoretical far-field gain, as measured in dBi, with respect to the angle from the antenna, which is measured in degrees. The plot shows that the patch antenna is a directional antenna, emitting a non-isotropic field in a directional pattern relative to the antenna. The theoretical plot shows that the antenna has a positive gain between plus and minus 45 degrees relative to the antenna. At an angle of zero degrees, the plot shows a maximum gain of 3.41 dBi. dBi is a unit for measuring the gain of an antenna. The reference level or dBi is the strength of the signal that would be transmitted by a non-directional isotropic antenna, i.e. an antenna which radiates equally in all directions. In practice, the radiation pattern may not be as perfect as that shown in the theoretical plot in FIG. 4.

While examples have been described for an antenna operating at a center frequency around 2.45 GHz, it is also possible to design the antenna for other license free frequencies such as 5.8 GHz, 24 GHz, and 60 GHz. The antenna may also be designed to operate within certain licensed frequencies.

Returning to FIG. 1, holes 115 in the yoke plate 114 (FIG. 1) are used for attachment of parts and communication between the PCBs. The holes can enable some amount of electromagnetic radiation from the antenna to leak through to the switching device 118 and to be radiated out the back of a junction box. The actual gain of the antenna is typically less than the theoretical maximum gain of 3.41 dBi. However, even with a reduced gain, one embodiment of the remotely controlled switching device can be used to receive a signal having a small amount of power. The RF antenna 110, in conjunction with the RF transceiver circuitry 256 (FIG. 2), can receive a signal having a power of at least −90 dBm. A signal of over +10 dBm can be fed to the antenna for transmission. The minimum received signal having a power of −90 dBm is over ten billion times weaker than the signal fed to the antenna. In order to receive signals having such a small power, steps are necessary to minimize noise received by the RF antenna.

Methods to reduce noise on the received signal typically involve filtering. A narrow bandpass filter can be used to filter off electromagnetic energy outside the bandwidth of the received signal. However, the radio frequency band around 2.45 GHz is heavily used. This can cause noise to be received even within the operating band of the antenna. Advanced transmission schemes can be used to minimize the effect of in-band interference. For example, the signal can be spread before it is transmitted using a specific psuedo-random code. When the spread signal is received, only a signal having the specific psuedo-random code is de-spread at the receiver. Other electromagnetic energy, both in-band and out-of-band, will be minimized when the received signal is de-spread.

Sophisticated time sharing and modulation schemes can be used to enable multiple remotely controlled switching devices to be used within range of each other with minimal interference. For example, the frequency band in which a signal is transmitted and received can be divided into sub-channels using frequency division multiplexing or frequency division multiple access. Alternatively, the entire bandwidth can be allotted to each device for a specific amount of time using time division multiple access. A combination of these techniques can be combined using code division multiple access. Complex modulation using bi-phase shift keying, quadrature-phase shift keying, or some form of quadrature amplitude modulation can help minimize interference and maximize the amount of data which can be transmitted.

Good filtering, modulation, and transmission schemes can be combined to enable each of the remotely controlled switching devices to have a high electromagnetic compatibility (EMC), causing negligible interference to other devices and receiving minimal interference from those devices. Electromagnetic compatibility is the ability of an electrical device to be used without causing interference in other electrical devices and minimizing interference received from other devices. For example, when an electric shaver or mixer is turned on, it should not cause a television to display static lines.

The system for remotely controlling an electrical switching device can also combine multiple RF circuits having multiple RF radio transceivers onto a single RF PCB. The resulting system can provide two or more separate RF circuits which are completely isolated with independent antenna systems connected to one micro controller on the switching PCB via an interconnect as described above.

Although dimmers have specifically been mentioned, additional embodiments can include other types of switching devices mounted in a J-box, such as keypads, which traditionally make use of a yoke plate simply for the purpose of mounting rather than for heat sinking as in the case of dimmers. The types of products in which the invention may be incorporated can be used by home owners, home automation users, persons within government facilities, persons within commercial installations, or persons within any other location desiring remote operation of switching devices.

In summary, the present invention is beneficial, in part, because an embodiment of the invention can move the antenna out in front of the shielding plate to improve its transmission pattern and to enable the remote wireless control of the switching device operate more effectively. In addition, the RF PCB and the geometries of the Decora opening area can be raised and sized to enable the antenna and RF PCT to be contained within the Decora opening area and to allow such improvements in the present invention. An effective use of the grounded yoke plate may be implemented in an embodiment of the invention to improve overall performance. Furthermore, the radio may be shielded from the rest of the circuitry using the yoke plate.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A system for remotely controlling an electrical switching device, comprising:

a mounting fixture configured to be mounted in a wall and having the electrical switching device supported by the mounting fixture;

a cover configured to cover at least a portion of the mounting fixture mounted in the wall;

a shielding plate configured to have high electrical conductivity, the shielding plate being mounted proximate to the mounting fixture between the cover and the electrical switching device; and a directional, non-isotropic radio frequency (RF) antenna sized to fit within the cover and configured to transmit RF signals, the RF antenna being located between the shielding plate and the cover at a predetermined distance from the shielding plate, wherein the predetermined distance is selected to increase a capability of the RF antenna to send and receive the RF signals.

2. The system of claim 1, wherein the RF antenna is a coplanar microstrip antenna.

3. The system of claim 2, wherein the coplanar microstrip antenna is a C-shaped, multilayer, microstrip patch antenna.

4. The system of claim 2, wherein the coplanar microstrip antenna is located on a first printed circuit board.

5. The system of claim 4, wherein the cover is a decora sized switch keycap configured to enable a user to control functions of a switching device.

6. The system of claim 5, wherein the RF antenna is sized to fit within the switch keycap.

7. The system of claim 5, wherein the first printed circuit board is sized to fit within the switch keycap.

8. The system of claim 4, further comprising RF transceiver circuitry including a low noise amplifier, a power amplifier, a radio transceiver, a transceiver clock, and power conditioning circuitry.

9. The system of claim 8, wherein the RF transceiver circuitry is configured to transmit and receive spread spectrum signals.

10. The system of claim 8, wherein the RF transceiver circuitry is configured to use orthogonal frequency division multiplexing.

11. The system of claim 8, further comprising a plurality of microstrip antennae and RF transceiver circuitry located on the first printed circuit board to enable simultaneous communication with multiple sources.

12. The system of claim 8, wherein the RF transceiver circuitry is located between the cover and the shielding plate.

13. The system of claim 8, wherein the RF transceiver circuitry is located on the first printed circuit board.

14. The system of claim 8, wherein the RF transceiver circuitry is configured to enable each remotely controlled electrical switching device to communicate with other remotely controlled electrical switching devices.

15. The system of claim 8, wherein the RF transceiver circuitry is configured to enable the electrical switching device to be controlled in a mesh network.

16. The system of claim 13, wherein the electrical switching device is located on a second printed circuit board.

17. The system of claim 16, wherein the shielding plate is located between the first printed circuit board and the second printed circuit board and configured to substantially attenuate RF signals generated by the electrical switching device to minimize interference with the RF antenna.

18. The system of claim 1, further comprising electrostatic discharge contacts coupled to the cover and configured to direct a static charge received at the junction box cover to ground.

19. The system of claim 1, further comprising a remote control configured to communicate with the RF antenna.

20. The system of claim 1, wherein the electrical switching device comprises a dimmer configured to switch a load on and off and further configured to vary power to a load.

21. The system of claim 20, wherein the load is selected from the group consisting of an incandescent light source, a fluorescent light source, and a motor.

22. A system for remotely controlling an electrical switching device, comprising:

a junction box configured to be mounted in a wall and having an electrical switching device within the junction box;

a decora sized switch keycap cover configured to cover at least a portion of the junction box mounted in the wall;

a shielding plate configured to have high electrical conductivity, the shielding plate being mounted proximate to the junction box between the switch keycap cover and the electrical switching device;

a directional, non-isotropic radio frequency (RF) antenna sized to fit within the switch keycap cover and configured to transmit RF signals, the RF antenna being located between the shielding plate and the switch keycap cover at a predetermined distance from the shielding plate, wherein the predetermined distance is selected to increase a capability of the RF antenna to send and receive the RF signals; and RF transceiver circuitry comprising a low noise amplifier, a power amplifier, a radio transceiver, and a radio transceiver clock, wherein the RF transceiver circuitry is located between the switch keycap cover and the shielding plate.

23. A system for remotely controlling an electrical switching device, comprising:

a junction box configured to be mounted in a wall and having an electrical switching device within the junction box;

a decora sized switch keycap cover configured to cover at least a portion of the junction box mounted in the wall;

a shielding plate configured to have high electrical conductivity, the shielding plate being mounted proximate to the junction box between the switch keycap cover and the electrical switching device;

a directional, non-isotropic radio frequency (RF) antenna sized to fit within the switch keycap cover and configured to transmit RF signals, the RF antenna being located between the shielding plate and the switch keycap cover at a predetermined distance from the shielding plate, wherein the predetermined distance is selected to increase a capability of the RF antenna to send and receive the RF signals; and RF transceiver circuitry comprising a low noise amplifier, a power amplifier, a radio transceiver, and a radio transceiver clock, wherein the RF transceiver circuitry is located between the switch keycap cover and the shielding plate and;

wherein the RF transceiver circuitry is configured to enable the remotely controlled electrical switching device to be controlled in a mesh network.

* * * * *